US012722856B2

(12) United States Patent
Choi et al.

(10) Patent No.: US 12,722,856 B2
(45) Date of Patent: Sep. 1, 2026

(54) CONTAINER FOR CONTENTS

(71) Applicant: Kolmar Korea Co., Ltd., Sejong (KR)

(72) Inventors: Sung Moo Choi, Sejong (KR); Hye Jin Jung, Sejong (KR); Chang Soo Yi, Sejong (KR); Jong Hyun Park, Sejong (KR)

(73) Assignee: Kolmar Korea Co., Ltd., Sejong (KR)

( * ) Notice: Subject to any disclaimer, the term of this patent is extended or adjusted under 35 U.S.C. 154(b) by 149 days.

(21) Appl. No.: 18/730,980

(22) PCT Filed: Oct. 7, 2022

(86) PCT No.: PCT/KR2022/015139

§ 371 (c)(1),
(2) Date: Jan. 18, 2025

(87) PCT Pub. No.: WO2023/177033

PCT Pub. Date: Sep. 21, 2023

(65) Prior Publication Data

US 2025/0136329 A1 May 1, 2025

(30) Foreign Application Priority Data

Mar. 17, 2022 (KR) ..... 10-2022-0033169

(51) Int. Cl.
*B65D 41/04* (2006.01)

(52) U.S. Cl.
CPC ..... *B65D 41/0485* (2013.01); *B65D 41/0492* (2013.01)

(58) Field of Classification Search
CPC ..... B65D 41/0485; B65D 41/0492; B65D 1/0246

(Continued)

(56) References Cited

U.S. PATENT DOCUMENTS 3,595,417 A * 7/1971 Musher ..... B65D 50/04 215/208
3,734,332 A * 5/1973 Grulich ..... B65D 50/063 215/208

(Continued)

FOREIGN PATENT DOCUMENTS

JP 2006-306449 A 11/2006
KR 10-1997-0001158 A 1/1997

(Continued)

OTHER PUBLICATIONS

English translation of KR790001158 provided by Google. (Year: 2025).*

*Primary Examiner* — James N Smalley
(74) *Attorney, Agent, or Firm* — Bridgeway IP Law Group, PLLC; Sang Ho Lee; Hyun Woo Shin

(57) ABSTRACT

A container for contents includes: a container part for accommodating contents; a cap part opening/closing the container part, and having at least one thread formed at the inner side thereof in a first direction; and a coupling part which is provided at one side of the container part, and which has a plurality of coupling units protruding along the outer peripheral surface thereof, wherein the plurality of coupling units are arranged to be spaced from each other in the first direction and a second direction that is opposite to the first direction, and are spaced apart in the second direction such that at least one first groove is formed in the first direction between the plurality of coupling units, and thus the cap part can be detachably coupled to the coupling part while the threads move.

10 Claims, 6 Drawing Sheets

(58) Field of Classification Search
USPC ..... 215/43, 329
See application file for complete search history.

(56) References Cited

U.S. PATENT DOCUMENTS

| | | | | |
|---|---|---|---|---|
| 4,273,248 | A * | 6/1981 | Lehmann | B65D 41/0478 215/334 |
| 4,289,248 | A * | 9/1981 | Lynn | B65D 41/0471 215/331 |
| 5,431,291 | A | 7/1995 | Labombarbe, Jr. | |
| 7,261,216 | B2 * | 8/2007 | Becker | B65D 47/122 215/44 |

FOREIGN PATENT DOCUMENTS

| | | | |
|---|---|---|---|
| KR | 20-2000-0014153 | U | 7/2000 |
| KR | 20-0425672 | Y1 | 9/2006 |

* cited by examiner

CONTAINER FOR CONTENTS

TECHNICAL FIELD

The present invention relates to a content container.

BACKGROUND ART

Container caps are detachably attached to containers in various manners and open or close the containers. Representatively, the manners include a screw coupling method of forming a screw thread on an outer circumferential surface of a neck portion formed on one side of the container and forming a screw thread on an inner circumferential surface of the cap, which corresponds to the screw thread formed on the outer circumferential surface.

According to the screw coupling manner, the screw thread on the neck portion is exposed to the outside in a state in which the cap is separated from the container. Because the screw thread is formed in a formal design in any container, only functional elements may be added to the container, and a design aesthetic sense may not be formed at all.

Further, in the case of the screw coupling manner, when an external force of a user is applied in a state in which the screw threads are aligned with each other, the coupling is achieved as the screw threads pass over each other. In this case, predetermined idle rotation is required for initial alignment of the threads, and thus unnecessary external force is consumed. For complete coupling, the external force of the user is continuously required.

DISCLOSURE

Technical Problem

The present invention is directed to providing a content container for solving the above problem.

The technical aspects of the present invention are not limited to the aspects described above, and those skilled in the art will clearly understand other technical aspects not described from the following descriptions.

Technical Solution

According to embodiments of the present invention, a content container is provided. The content container includes a container part that accommodates a content, a cap part which opens or closes the container part and in which at least one screw thread is formed in a first direction, and a coupling part which is provided on one side of the container part and from which a plurality of coupling units protrude along an outer circumferential surface thereof, wherein the plurality of coupling units are disposed to be spaced apart from each other in the first direction and a second direction opposite to the first direction, and due to being spaced apart in the second direction, at least one first groove is formed between the plurality of coupling units in the first direction, and as the screw thread moves, the cap part is detachably coupled to the coupling part.

Due to being spaced apart in the first direction, at least one second groove forming a non-contact area with the screw thread may be formed between the plurality of coupling units in the second direction.

As a cross-sectional area of the coupling unit may be decreased in a protruding direction, a contact area with the screw thread may be decreased.

A bottom surface of the coupling unit may have at least one of a circular shape, an elliptic shape, and a polygonal shape.

The coupling unit may have a polygonal bottom surface, and the polygonal shape may have at least one side formed in the first direction to guide movement of the screw thread.

The bottom surface may have a diamond shape, and an angle of an upper vertex thereof may be in a range of 49.5° to 160°.

At least one entrance that guides an end of the screw thread to the first groove may be formed between the plurality of coupling units positioned at an uppermost end by the coupling part being spaced apart in a circumferential direction.

The coupling part may include at least one first fixing portion formed on a lower side of the coupling unit, and the cap part may include at least one second fixing portion that is formed on a lower side of the screw thread and maintains coupling with the cap part while in contact with the first fixing portion.

At least one of the first fixing portion and the second fixing portion may be provided as the number of portions corresponding to the screw thread, and when the cap part is coupled to the coupling part, the first fixing portion and the second fixing portion may come into contact with each other regardless of an initial alignment position of the cap part.

In a process of coupling or decoupling the cap part to or from the coupling part, the first fixing portion and the second fixing portion may come into contact with each other, and thus predetermined resistance may be generated between the first fixing portion and the second fixing portion.

The cap part may include an inner cap in which the screw thread is formed on an inner side thereof and at least one insertion protrusion is formed on an outer side thereof and an outer cap in which at least one insertion groove corresponding to the insertion protrusion is formed in an inner side thereof and which is coupled to surround the inner cap.

According to embodiments of the present invention, a content container is provided. The content container includes a container part that accommodates a content, a cap part which opens or closes the container part and in which a plurality of coupling units protrude along an inner circumferential surface thereof, and a coupling part which is provided on one side of the container part and in which at least one screw thread is formed on an outer side thereof in a first direction, wherein the plurality of coupling units are disposed to be spaced apart from each other in the first direction and a second direction opposite to the first direction, and due to being spaced apart in the second direction, at least one first groove is formed between the plurality of coupling units in the first direction, and as the screw thread moves, the cap part is detachably coupled to the coupling part.

According to embodiments of the present invention, a content container is provided. The content container includes a container part that accommodates a content, a cap part that opens or closes the container part, a coupling part which is provided on one side of the container part and from which a plurality of first coupling units protrude along an outer circumferential surface thereof, and a second coupling part from which a plurality of second coupling units protrude along an inner circumferential surface of the cap part, wherein the first coupling units and the second coupling units are disposed to be spaced apart from each other in a first direction and a second direction opposite to the first direction.

A first groove may be formed by the plurality of first coupling units being spaced apart in the first direction, a second groove may be formed by the plurality of first coupling units being spaced apart in the second direction, the second coupling units may move along the first groove and the second groove, and the cap part and the coupling part may be detachably coupled to each other.

Advantageous Effects

According to the present invention, a plurality of coupling units rather than a screw thread are formed in a coupling part to screw-couple a container part and a cap part, and thus a stereotypical aesthetic sense represented by the screw thread may be avoided, and a new aesthetic sense represented by the coupling unit may be provided.

Further, according to the present invention, a frictional force is decreased as compared to a traditional screw coupling method using a plurality of screw threads, the cap part and the container part may be coupled automatically or with a small external force, and thus use thereof is convenient.

Further, according to the present invention, the cap part and the container part may be firmly coupled to each other by a fixing part, and thus a sealing force may be improved.

Further, according to the present invention, as long as the cap part is positioned at an upper end of the coupling part, the coupling between the cap part and the coupling part may be started and completed regardless of an initial alignment position of the cap part and the coupling part, and thus idle rotation and an external force of a user required for the screw coupling may be eliminated.

DESCRIPTION OF DRAWINGS

A brief description of each drawing is provided to more fully understand the drawings cited in a detailed description of the present invention.

MODES OF THE INVENTION

Figure 1:
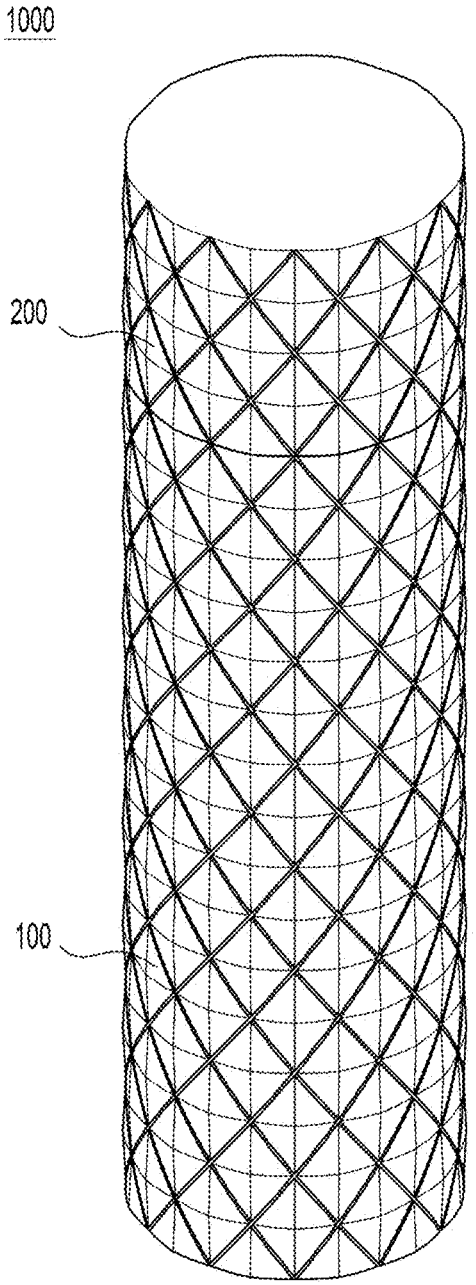
FIG. 1 is a perspective view of a content container according to an embodiment of the present invention.

Hereinafter, embodiments of the present invention will be described in detail with reference to contents described in the accompanying drawings. Further, a method of configuring and using a device according to an embodiment of the present invention will be described in detail with reference to the contents described in the accompanying drawings. The same reference numerals or symbols presented in each drawing indicate parts or components that perform substantially the same function. Hereinafter, for convenience of description, up, down, left, and right directions are based on the drawings, and the scope of the present invention is not necessarily limited to the corresponding directions.

Terms including ordinal numbers such as "first" and "second" may be used to describe various components, but the components are not limited by the terms. The terms are used only for the purpose of distinguishing one component from another component. For example, without departing from the scope of the present invention, a first component may be referred to as a second component, and similarly, the second component may be referred to as the first component. The term "and/or" includes a combination of a plurality of related items or any one time among the plurality of related items.

Terms used in the specification are used only to describe embodiments and are not intended to limit and/or restrict the present invention. Singular expressions include plural expressions unless clearly otherwise indicated in the context. It should be understood that terms such as "include" and "have" herein are intended to indicate that there are features, numbers, steps, operations, components, parts, or combinations thereof that are described in the specification, and do not exclude, in advance, the possibility of the presence or addition of one or more other features, numbers, steps, operations, components, parts, or combinations thereof.

Throughout the specification, when a first part is connected to a second part, this includes not only a case in which the first part is directly connected to the second part but also a case in which the first part is indirectly connected to the second part with a third component disposed therebetween. Further, when a part includes a component, this means that another component is not excluded but may be further included unless otherwise stated.

Figure 2:
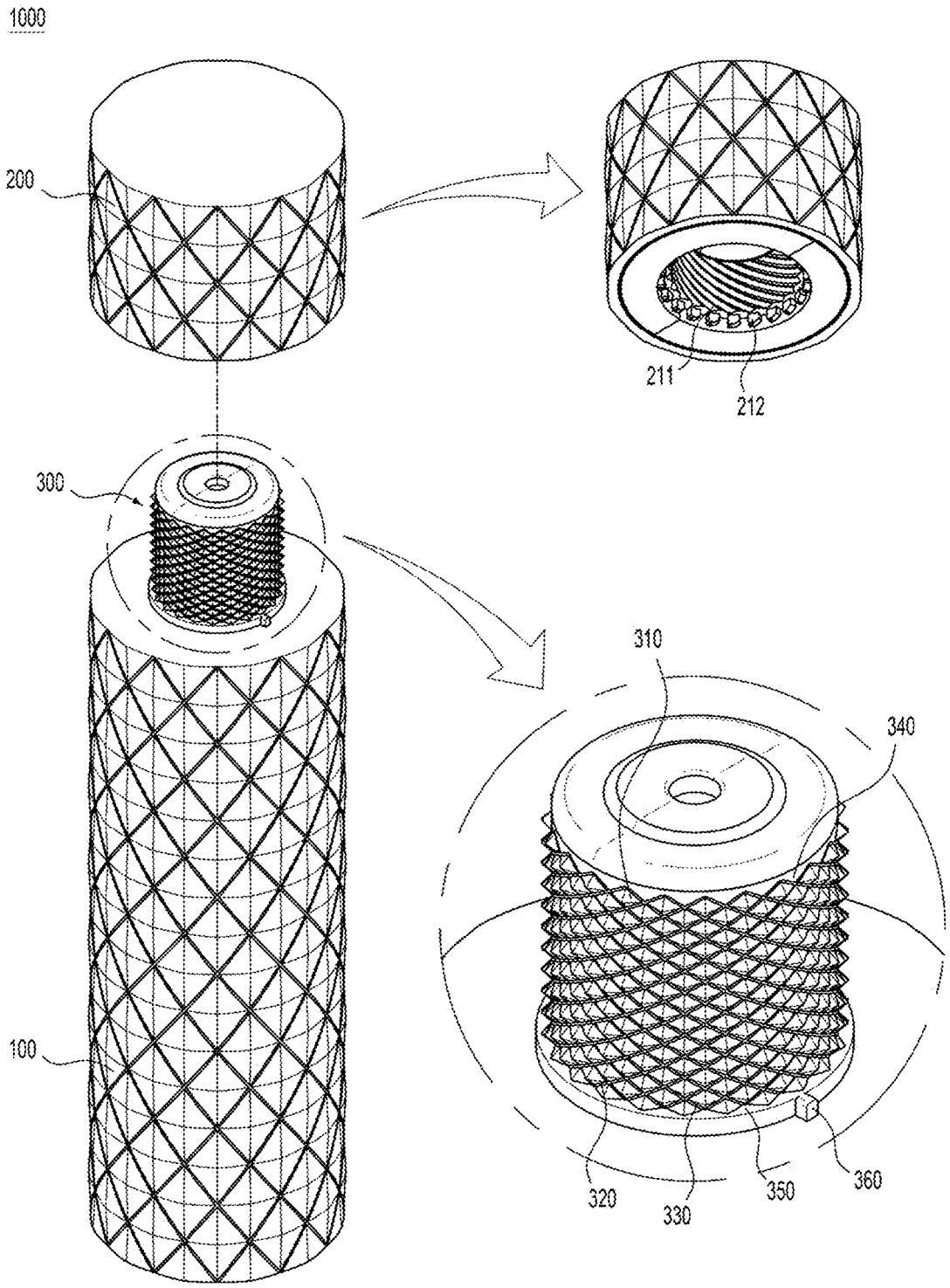
FIG. 2 is an exploded perspective view of the content container according to the embodiment of the present invention.
Figure 3:
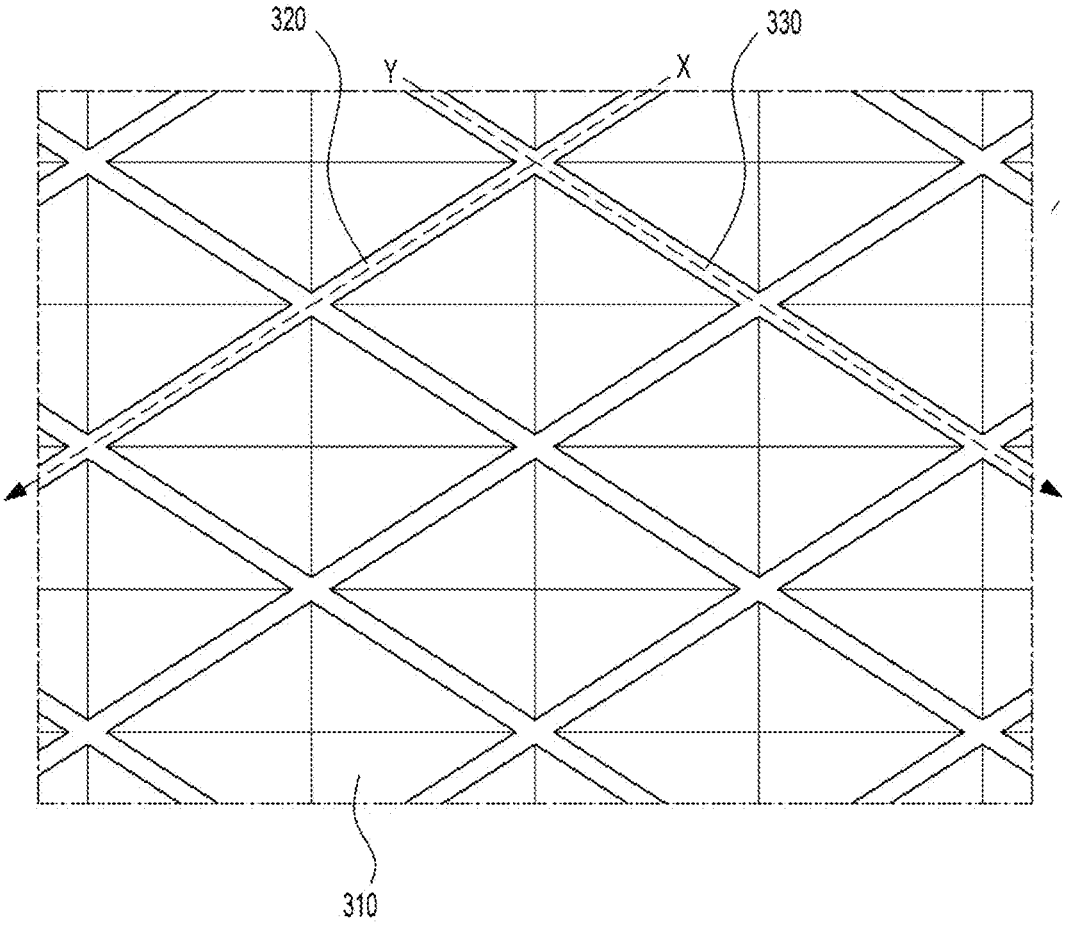
FIG. 3 is a developed view of a coupling part according to the embodiment of the present invention.

FIG. 1 is a perspective view of a content container according to an embodiment of the present invention, FIG. 2 is an exploded perspective view of the content container according to the embodiment of the present invention, and FIG. 3 is a developed view of a coupling part according to the embodiment of the present invention. In this case, FIG. 3 illustrates only one area of the coupling part, and the other area is omitted.

Referring to FIGS. 1 to 3, a content container 1000 may include a container part 100, a cap part 200, and a coupling part 300.

The container part 100 may accommodate contents. In this case, the content may be liquid, gel, or powder cosmetics. For example, the content may include lotion, milk lotion, moisture lotion, nutritional lotion, skin lotion, skin softener, skin toner, astringent, massage cream, nutritional cream, moisture cream, whitening essence, tone-up cream, sunscreen, suncream, sunmilk, BB cream, base, foundation, CC cream, concealer, blusher, shading, eye shadow, eyebrow, eye cream, primer or the like. However, the present invention is not limited thereto, and other formulations or types of cosmetics, medical contents, and the like may be applied.

The cap part 200 may open or close the container part 100. To this end, the cap part 200 may be directly/indirectly coupled to the container part 100 through the coupling part 300. In more detail, the cap part 200 may be coupled to the coupling part 300 to seal the container part 100 and may be separated from the coupling part 300 to open the container part 100 so that the content in the container part 100 may be used. For example, the cap part 200 may include at least one screw thread 211 for the coupling with the coupling part 300 and include at least one second fixing portion 212 for maintaining the coupling. However, the present invention is not limited thereto.

The coupling part 300 may be provided on one side of the container part 100 and may be detachably coupled to the cap part 200.

According to embodiments, the coupling part 300 may be formed in one area of the container part 100. In detail, for example, the coupling part 300 may be positioned at a neck portion of the container part 100. However, this is illustrative, and the coupling part 300 may be formed at various positions inside the container part 100 so that the coupling part 300 is suitable for the coupling with the cap part 200.

According to embodiments, the coupling part 300 may be a separate component from the container part 100 and may be directly/indirectly coupled to the container part 100. For example, the coupling part 300 may be directly coupled to the container part 100 through screw coupling, insertion coupling, or the like or may be indirectly coupled to the container part 100 with at least one component (e.g., a pump assembly, a shoulder part, or the like) interposed therebetween.

In the embodiment, the coupling part 300 and the cap part 200 may be screw-coupled to each other. To this end, a plurality of coupling units 310 may be formed to protrude from the coupling part 300 along an outer circumferential surface thereof, and the at least one screw thread 211 may be formed inside the cap part 200. As the screw thread 211 moves along a separation space between the plurality of coupling units 310, the coupling part 300 and the cap part 200 may be screw-coupled to each other. However, the present invention is not limited thereto, and various embodiments in which the at least one screw thread is formed outside the coupling part 300 and the plurality of coupling units are formed to protrude from the cap part 200 along an inner circumferential surface thereof or in which the plurality of coupling units are formed to protrude from the outer circumferential surface of the coupling part 300 and the inner circumferential surface of the cap part 200 may be applied.

In the embodiment, the screw thread 211 may be formed in a first direction, and the plurality of coupling units 310 may be spaced apart from each other in the first direction and a second direction opposite to the first direction. In detail, as illustrated in FIG. 3, herein, the first direction may mean a spiral direction X descending in a clockwise direction from an upper end, and the second direction may mean a spiral direction Y descending in a counterclockwise direction from the upper end. However, the first direction and the second direction are not limited thereto, and the first direction and the second direction may be defined as opposite directions or may be defined as various other directions.

In the embodiment, because the plurality of coupling units 310 are spaced apart from each other in the second direction, at least one first groove 320 may be formed between the plurality of coupling units 310 in the first direction. The screw thread 211 may move along the first groove 320, and accordingly, the cap part 200 may be detached from the coupling part 300.

In the embodiment, because the plurality of coupling units 310 are spaced apart from each other in the first direction, at least one second groove 330 may be formed between the plurality of coupling units 310 in the second direction. A non-contact area with the screw thread 211 may be formed between the plurality of coupling units 310 by the second groove 330. A frictional force between the screw thread 211 and the coupling unit 310 may be decreased by the non-contact area.

In the embodiment, a cross-sectional area of the coupling unit 310 may be decreased in a protrusion direction. Due to the decrease in the cross-sectional area, a contact area between the coupling unit 310 and the screw thread 211 may be decreased in the protruding direction. Due to the decrease in the contact area, the frictional force between the screw thread 211 and the coupling unit 310 may be decreased.

In the embodiment, as the frictional force between the screw thread 211 and the plurality of coupling units 310 is decreased, an external force required to couple the cap part 200 and the coupling part 300 may be decreased. Therefore, even in a state in which a small external force is applied or a state in which no external force is applied (e.g., due to the gravity or the like), the screw thread 211 may move along the first groove 320.

In the embodiment, the coupling unit 310 may include a bottom surface in contact with a surface of the container part 100 and a protrusion area extending outward from the bottom surface. The bottom surface may have, for example, a polygonal shape, an elliptic shape, or a circular shape. Here, the polygonal shape of the bottom surface may include a shape in which at least a portion, for example, at least one side, at least one vertex or the like is formed in a curved line in addition to a straight line. Further, the protrusion area may extend outward from the bottom surface and may be formed such that an end thereof is sharp or a cross-sectional area is decreased. Thus, the coupling unit 310 may have a shape of, for example, a polygonal column, a polygon pyramid, a polygonal prismoid, a hemisphere, a cylinder, a truncated cone, or a cone. However, this is illustrative, and various shapes may be applied to the coupling unit 310.

In the embodiment, the coupling unit 310 may guide movement of the screw thread 211 along the first groove 320 through the bottom surface. To this end, at least a portion of a circumference of the bottom surface of the coupling unit 310 may be formed in the first direction. Here, the fact that the at least a portion of the circumference is formed in the first direction may include a case in which the entire area of at least one side of the bottom surface is formed in the first direction as well as a case in which only a partial area of the corresponding side is formed in the first direction to the extent that the screw thread 211 moves in the first direction.

In the embodiment, at least one entrance 340 or 350 may be formed at an upper end and/or a lower end of the coupling part 300. This may be formed as the plurality of coupling units 310 are spaced apart from each other in a circumferential direction of the coupling part 300. For example, the at least one first entrance 340 may be formed between the plurality of coupling units 310 positioned at an uppermost end, and the at least one second entrance 350 may be formed between the plurality of coupling units 310 positioned at a lowermost end. When the cap part 200 is coupled to the coupling part 300, an end of the screw thread 211 may be input into the first groove 320 through the first entrance 340, and when the cap part 200 is completely coupled to the coupling part 300, the end of the screw thread 211 may be separated from the first groove 320 through the second entrance 350. Further, when the cap part 200 is separated from the coupling part 300, the end of the screw thread 211 may be input into the first groove 320 through the second entrance 350, and when the cap part 200 is completely separated from the coupling part 300, the end of the screw thread 211 may be separated from the first groove 320 through the first entrance 340.

In the embodiment, the first entrance 340 may guide the end of the screw thread 211 to the first groove 320. In more detail, when the end of the screw thread 211 is disposed at a predetermined position on the first entrance 340, the end of the screw thread 211 may move toward the first groove 320 along a surface of the coupling unit 310 by the gravity. That is, as long as the cap part 200 is disposed at an upper end of the coupling part 300 regardless of an alignment position of the cap part 200 and the coupling part 300, the end of the screw thread 211 may be guided to the first groove 320 by the first entrance 340, the screw thread 211 may move along the first groove 320, and the cap part 200 and the coupling part 300 may be automatically coupled to each other.

In the embodiment, the coupling part 300 may include at least one first fixing portion 360, and correspondingly, the cap part 200 may include the at least one second fixing portion 212. For example, the first fixing portion 360 may be formed on a lower side of the coupling unit 310, and the second fixing portion 212 may be formed on a lower side of the screw thread 211. The first fixing portion 360 and the second fixing portion 212 may come into in contact with each other, thereby maintaining the coupling between the cap part 200 and the coupling part 300. In detail, in a state in which the screw thread 211 completely passes through the first groove 320, the first fixing portion 360 and the second fixing portion 212 come into contact with each other. In this case, an external force enough to allow the second fixing portion 212 to pass over the first fixing portion 360 is required to separate the cap part 200, and thus the cap part 200 cannot be separated from the coupling part 300 without an external force having a predetermined magnitude or more.

In the embodiment, the first fixing portion 360 may include at least one first coupling protrusion that protrudes outward from the coupling part 300, and the second fixing portion 212 may include a plurality of second coupling protrusions that protrude inward from the cap part 200. The first fixing portion 360 may be inserted between the second coupling protrusions. In this case, both sides of the first coupling protrusion may be formed as support walls that support the second coupling protrusions while in contact with the second coupling protrusions. However, the present invention is not limited thereto, and according to embodiments, various configurations in which the first fixing portion 360 includes a plurality of first coupling protrusions, the second fixing portion 212 includes at least one second coupling protrusion, and the second coupling protrusion is inserted between the first coupling protrusions may be applied.

In the embodiment, a curved surface that connects the support walls formed on both sides of the first fixing portion 360 may be formed at an upper end of the first fixing portion 360. When the cap part 200 is coupled to or separated from the coupling part 300, the second fixing portion 212 may move while in contact with the curved surface.

In the embodiment, one lower area of the second fixing portion 212 may protrude downward as compared to the other area. In this case, when the second fixing portion 212 moves along the first fixing portion 360, the one area of the second fixing portion 212, which protrudes downward, may move along the curved surface of the first fixing portion 360 (e.g., while being elastically deformed). That is, because the one lower area of the second fixing portion 212 protrudes downward, the other area of the second fixing portion 212 may be not in contact with the first fixing portion 360, a contact area between the second fixing portion 212 and the first fixing portion 360 may be decreased, and accordingly, the second fixing portion 212 may easily move along the first fixing portion 360 due to the elastic deformation.

In the embodiment, in a process of coupling and/or separating the cap part 200 and the coupling part 300, predetermined resistance may be generated between the first fixing portion 360 and the second fixing portion 212, the generated resistance may be transmitted to a user, and thus the user may easily identify whether the cap part 200 and the coupling part 300 are coupled and/or separated. In detail, when the cap part 200 is coupled to or separated from the coupling part 300, and when a lower surface (and/or a surface adjacent thereto) of the second fixing portion 212 comes into contact with an upper surface (and/or a surface adjacent thereto) of the first fixing portion 360, the resistance may be generated in a direction in which the contact is released (i.e., a separation direction or coupling direction) due to friction between the first fixing portion 360 and the second fixing portion 212.

In the embodiment, at least one of the first fixing portion 360 and the second fixing portion 212 may be provided as the number of portions corresponding to the number of screw threads 211. Accordingly, when the cap part 200 is coupled to the coupling part 300, the first fixing portion 360 and the second fixing portion 212 may be in contact with each other regardless of an initial alignment position of the cap part 200. For example, two first fixing portions 360 may be formed at both ends of the coupling part 300, and the second fixing portions 212 may be formed along a lower inner circumferential surface of the cap part 200 such that the number thereof corresponds to the number of screw threads 211, but the present invention is not limited thereto.

The content container 1000 according to FIGS. 1 to 3 is illustrative, and various configurations may be applied according to embodiments to which the present invention is applied. For example, the coupling part 300 may be formed in one area of the cap part 200. For example, the coupling part 300 may be formed inside the cap part 200, and thus the plurality of coupling units 310 may be formed along the inner circumferential surface of the cap part 200. In this case, at least one screw thread may be formed at a neck portion of the container part 100, and as the container part 100 and the coupling part 300 are screw-coupled to each other, the cap part 200 may be coupled to the container part 100. Further, for example, the coupling part 300 may be provided as a plurality of coupling parts 300, and the respective coupling parts 300 may be positioned in the container part 100 and the cap part 200. In detail, the first coupling part may be provided in the container part 100 (particularly, in a position of the neck portion of the container part 100), and the second coupling part may be provided in the cap part 200 (particularly, in an interior of the cap part 200). In this case, a plurality of first coupling units may be formed along an outer circumferential surface of the container part 100, a plurality of second coupling units may be formed along the inner circumferential surface of the cap part 200, and as the first coupling unit and the second coupling unit may be coupled to each other, the container part 100 and the cap part 200 may be coupled to each other. In this way, even embodiments in which the position or configuration of the coupling part 300 is changed may be described like FIGS. 1 to 3, but for simplicity of description, a duplicated description thereof will be omitted.

Figure 4:
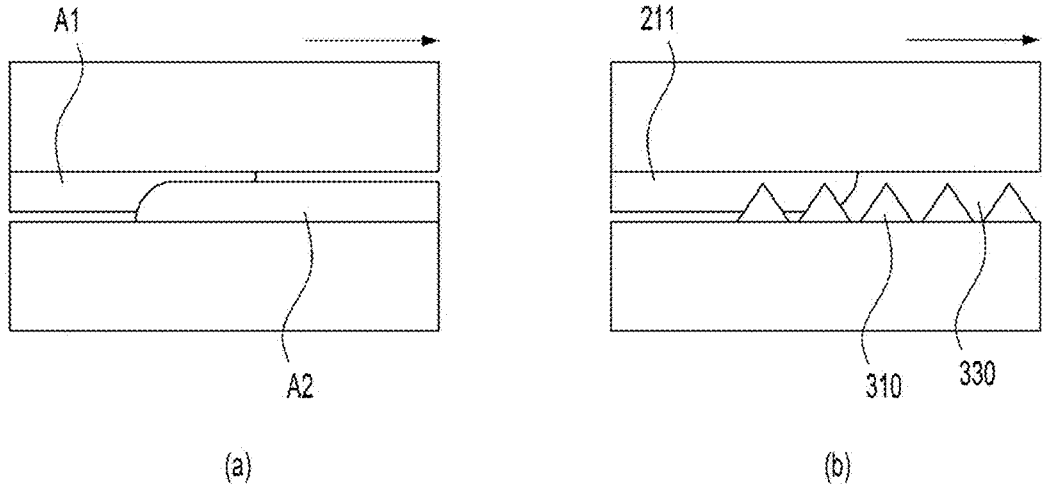
FIG. 4A is a view describing coupling between a coupling unit and a screw thread according to related art.
FIG. 4B is a view for describing coupling between a coupling unit and a screw thread according to the embodiment of the present invention.

FIG. 4 is a view for describing coupling between a coupling unit and a screw thread according to the embodiment of the present invention. In detail, FIG. 4A illustrates a screw coupling structure according to the related art, and FIG. 4B illustrates a coupling structure according to the embodiment of the present invention.

First, according to the screw coupling structure according to the related art, which is illustrated in FIG. 4A, when two members are coupled to each other through a first screw thread A1 and a second screw thread A2, a frictional force may be generated on the entire area in which the first screw thread A1 and the second screw thread A2 are in contact with each other.

On the other hand, referring to FIG. 4B, when the cap part 200 and the coupling part 300 are coupled to each other through the screw thread 211 and the plurality of coupling units 310, the non-contact area between the screw thread 211 and the coupling units 310 may be generated by the second groove 330 between the plurality of coupling units 310. In particular, the cross-sectional area of the coupling unit 310 may be decreased in the protruding direction, the contact area between the screw thread 211 and the coupling unit 310 may be further decreased, and as a result, a frictional force between the coupling unit 310 and the screw thread 211 may be decreased. Due to the decrease in the frictional force, when the cap part 200 and the coupling part 300 are aligned such that the screw thread 211 is disposed between the plurality of coupling units 310, the screw thread 211 may automatically move along the first groove 320 even by the gravity or a small external force.

The coupling between the coupling unit 310 and the screw thread 211 illustrated in FIG. 4 is illustrative, and various configurations may be applied according to the embodiment to which the present invention is applied.

Figure 5:
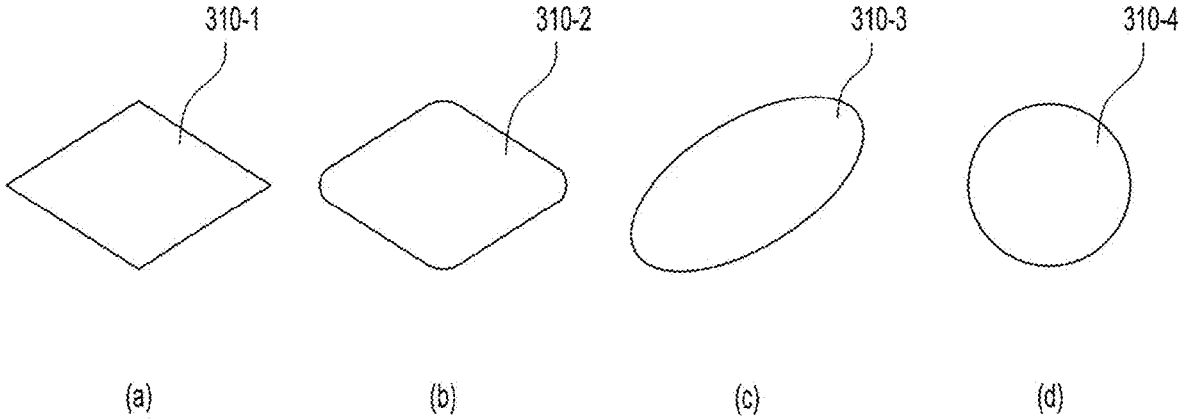
FIG. 5 is a view for describing the coupling unit according to the embodiment of the present invention.

FIG. 5 is a view for describing the coupling unit according to the embodiment of the present invention.

Referring to FIGS. 5A and 5B, bottom surfaces of coupling units 310-1 and 310-2 may be formed in a polygonal shape. In this case, the bottom surface having the polygonal shape may have an entirely straight line as illustrated in FIG. 5A or may have some curved areas as illustrated in FIG. 5B. In this case, the bottom surfaces of the coupling units 310-1 and 310-2 may guide movement of the screw thread 211 in the first direction through at least one side formed in the first direction as a whole.

Referring to FIG. 5C, a bottom surface of a coupling unit 310-3 may be formed in an elliptic shape. When the bottom surface is formed in the elliptic shape, at least a portion of a circumference of the bottom surface may be formed in the first direction to guide the movement of the screw thread 211 in the first direction. For example, a direction of a long axis or a direction of a short axis of the elliptic shape may correspond to the first direction.

Referring to FIG. 5D, a bottom surface of a coupling unit 310-4 may be formed in a circular shape. When the bottom surface is formed in the circular shape, a gap between the plurality of coupling units 310-4 may be adjusted to guide the movement of the screw thread 211 in the first direction. For example, a gap between the plurality of coupling units 310-4 in the first direction may be adjusted to be smaller than a gap therebetween in the second direction. The gap between the plurality of coupling units 310-4 may be applied even to the coupling units 310-1 and 310-2 having the polygonal bottom surfaces or the coupling unit 310-3 having the elliptic bottom surface in addition to the coupling unit 310-4 having the circular bottom surface.

The shape of the bottom surface of the coupling unit 310 may be appropriately selected depending on a bonding strength between the cap part 200 and the coupling part 300, a desired aesthetic sense, or the like. For example, when it is intended to improve the bonding strength, the coupling units 310-1 and 310-2 having the polygonal bottom surfaces, especially, the coupling unit 310-1 formed entirely in the straight line, may be selected to increase the contact area with the screw thread 211. In contrast, when it is intended to decrease the bonding strength between the cap part 200 and the coupling part 300, the coupling unit 310-3 having the elliptic bottom surface or the coupling unit 310-4 having the circular bottom surface may be selected to decrease the contact area with the screw thread 211. Further, for example, when it is intended to form a sharp and angular aesthetic sense through the coupling unit 310, the coupling units 310-1 and 310-2 having the polygonal bottom surface may be selected. In contrast, when it is intended to form a round and gentle aesthetic sense through the coupling unit 310, the coupling unit 310-3 having the elliptic bottom surface or the coupling unit 310-4 having the circular bottom surface may be selected. Further, this selection is illustrative, and the shape of the coupling unit 310 may be selected in comprehensive consideration of various factors.

The shape of the coupling unit 310 according to FIG. 5 is illustrative, and various configurations may be applied according to the embodiment to which the present invention is applied.

Figure 6:
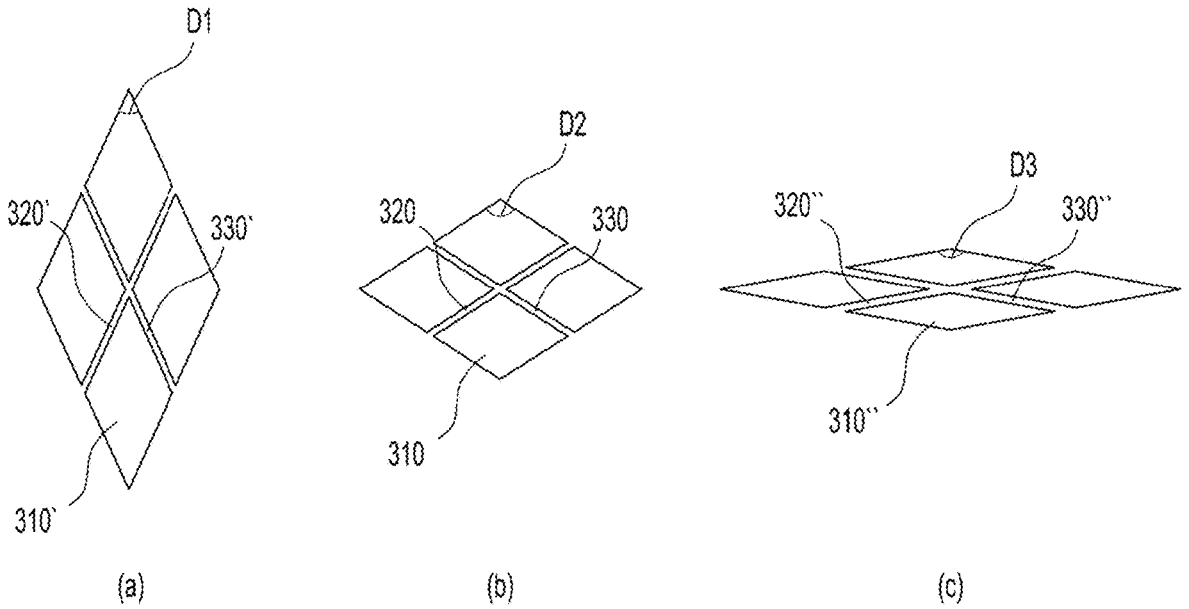
FIG. 6 is a view for describing the coupling unit according to the embodiment of the present invention.

FIG. 6 is a view for describing the coupling unit according to the embodiment of the present invention.

Referring to FIG. 6, bottom surfaces of coupling units 310, 310', and 310" may be formed in a diamond shape. In this case, angles D1 to D3 of upper vertices of the bottom surfaces having the diamond shape may be appropriately selected as long as the screw thread 211 may move along the first groove 320 and the coupling is stably maintained.

For example, as illustrated in FIG. 6, the angles of the upper vertices of the bottom surfaces of the coupling units 310, 310', and 310" may be in a range of 49.5° (see FIG. 5A) to 160° (see FIG. 5C) and may preferably be 115° (see FIG. 5B).

When the angles of the upper vertices are less than 49.5°, first grooves 320, 320', and 320" may be formed too steeply, and thus the cap part 200 may be too easily separated from the coupling part 300. Further, when the angles of the upper vertices are greater than 160°, the first grooves 320, 320', and 320" are formed too gently, and thus too much rotation may be required to couple the cap part 200 to the coupling part 300 or the cap part 200 may not be automatically coupled to the coupling part 300.

The shapes and the angles of the upper vertices of the coupling units 310, 310', and 310" according to FIG. 6 are illustrative, and various configurations may be applied according to the embodiment to which the present invention is applied.

Figure 7:
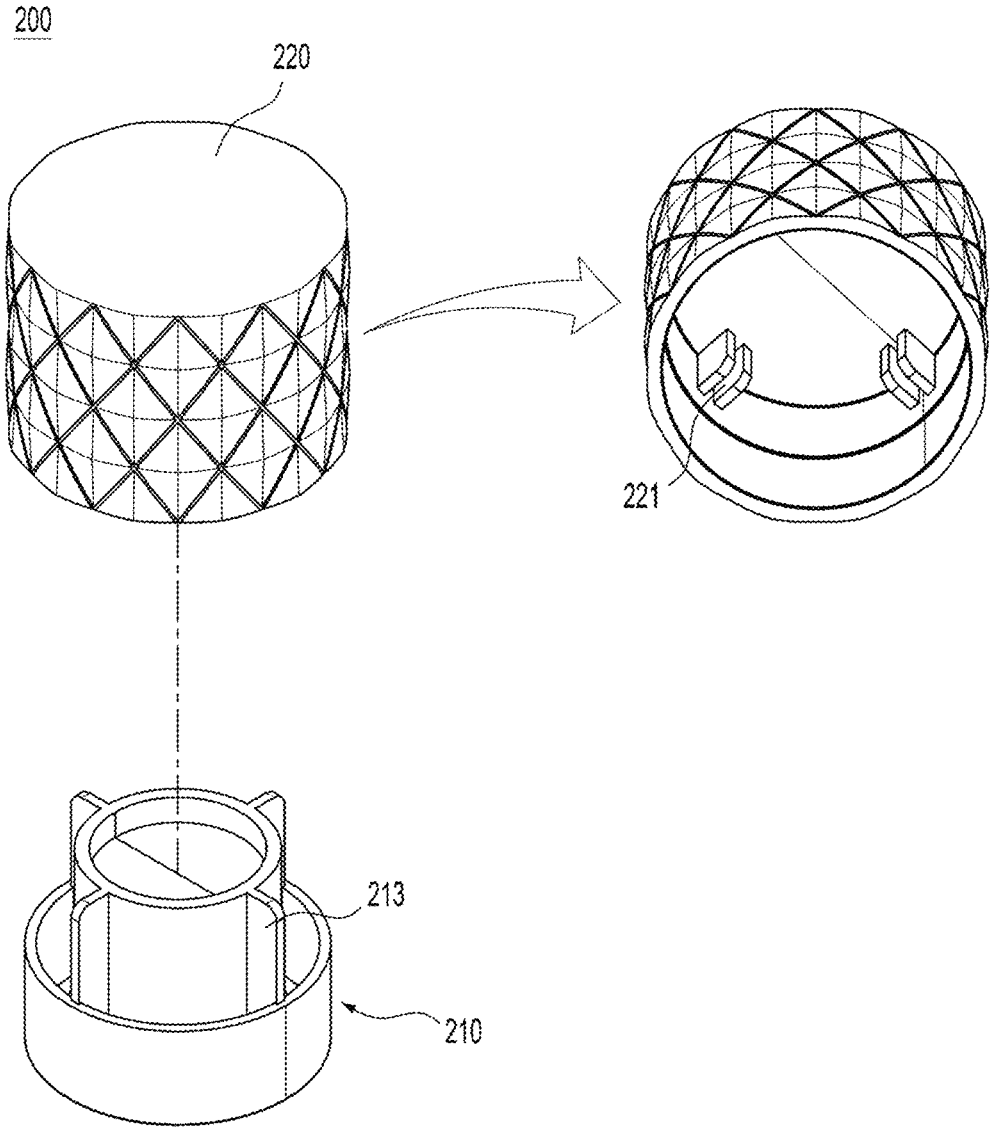
FIG. 7 is an exploded perspective view of a cap part according to the embodiment of the present invention.

FIG. 7 is an exploded perspective view of a cap part according to the embodiment of the present invention.

Referring to FIG. 7, the cap part 200 may include an inner cap 210 and an outer cap 220. The inner cap 210 may have the screw thread 211 and the second fixing portion 212 formed therein and may be coupled to the coupling part 300, and the outer cap 220 may be coupled to surround the inner cap 210 and may shield the inner cap from the outside.

In the embodiment, the inner cap 210 may be insertion-coupled to the outer cap 220. To this end, for example, at least one insertion protrusion 213 may be formed outside the inner cap 210, and at least one insertion groove 221 corresponding to the insertion protrusion 213 may be formed inside the outer cap 220. However, the present invention is not limited thereto, and various widely-known coupling methods such as screw coupling and locking coupling may be applied to the inner cap 210 and the outer cap 220.

The cap part 200 according to FIG. 7 is illustrative, and various configurations may be applied according to the embodiment to which the present invention is applied. For example, not the screw thread 211 but the coupling part 300 may be formed inside the inner cap 210, and correspondingly, the screw thread 211 may be formed in the container part 100.

As described above, optimal embodiments are disclosed in the drawings and the specification. Although specific terms are used herein, the terms are used only for describing the present invention and are not used to limit the meaning or the scope of the present invention described in the appended claims. Therefore, it should be understood by those skilled in the art that various modifications and other equivalent embodiments are possible therefrom. Thus, the true technical scope of the present invention should be determined by the technical spirit the appended claims.

The invention claimed is:

1. A content container comprising:

a container part configured to accommodate content;

a cap part configured to open or close the container part and in which at least one screw thread is disposed in a first direction; and a coupling part disposed on one side of the container part and from which a plurality of coupling units protrude along an outer circumferential surface thereof, wherein, as a cross-sectional area of each of the plurality of coupling units is decreased in a protruding direction, a contact area with the at least one screw thread is decreased, wherein the plurality of coupling units are disposed to be spaced apart from each other in the first direction and in a second direction, wherein the second direction is opposite to the first direction, and due to being spaced apart in the second direction, at least one first groove is formed between the plurality of coupling units in the first direction, and as the at least one screw thread moves through the at least one first groove, the cap part is detachably coupled to the coupling part.

2. The content container of claim 1, wherein, due to being spaced apart in the first direction, at least one second groove forming a non-contact area with the at least one screw thread is formed between the plurality of coupling units in the second direction.

3. The content container of claim 1, wherein a bottom surface of each of the plurality of coupling units has at least one of a circular shape, an elliptic shape, or a polygonal shape.

4. The content container of claim 3, wherein the bottom surface of the each of the plurality of coupling units has a polygonal shape, and the polygonal shape has at least one side formed in the first direction to guide the movement of the at least one screw thread.

5. The content container of claim 4, wherein the polygonal shape of the bottom surface is a diamond shape, and an angle of an upper vertex thereof is in a range of 49.5° to 160°.

6. The content container of claim 1, wherein at least one entrance configured to guide an end of the at least one screw thread to the at least one first groove is formed between the plurality of coupling units positioned at an uppermost end of the coupling part, and the at least one entrance is formed to be spaced apart in a circumferential direction of the coupling part.

7. The content container of claim 1, wherein the coupling part includes at least one first fixing portion disposed on a lower side of the coupling unit, and the cap part includes at least one second fixing portion that is disposed on a lower side of the at least one screw thread and is configured to come in contact with the at least one first fixing portion of the coupling part when the cap part is coupled to the coupling part.

8. The content container of claim 7, wherein a number of at least one of the at least one first fixing portion or the at least one second fixing portion corresponds to a number of the at least one screw thread, and when the cap part is coupled to the coupling part, the at least one first fixing portion and the at least one second fixing portion come into contact with each other regardless of an initial alignment position of the cap part.

9. The content container of claim 7, wherein in a process of coupling or decoupling the cap part to or from the coupling part, the at least one first fixing portion and the at least one second fixing portion come into contact with each other, and a predetermined resistance is generated between the at least one first fixing portion and the at least one second fixing portion.

10. The content container of claim 1, wherein the cap part comprises:

an inner cap in which the at least one screw thread is disposed on an inner side thereof and at least one insertion protrusion is disposed on an outer side thereof, and an outer cap coupled to the inner cap to surround the inner cap, wherein at least one insertion groove corresponding to the at least one insertion protrusion is disposed in an inner side of the outer cap.

* * * * *